US005910997A

United States Patent [19]

Ishige et al.

[11] Patent Number: 5,910,997

[45] Date of Patent: Jun. 8, 1999

[54] DIGITALLY PROGRAMMABLE HEARING AID COMMUNICABLE WITH EXTERNAL APPARATUS THROUGH ACOUSTIC SIGNAL

[75] Inventors: Ryuuichi Ishige; Reishi Kondo, both of Tokyo, Japan

[73] Assignee: NEC Corporation, Tokyo, Japan

[21] Appl. No.: 08/732,879

[22] Filed: Oct. 16, 1996

[30] Foreign Application Priority Data

Oct. 17, 1995 [JP] Japan ..... 7-268188

[51] Int. Cl.[6] ..... H04R 25/00

[52] U.S. Cl. ..... 381/314; 381/312

[58] Field of Search ..... 381/68, 68.2, 68.4

[56] References Cited

U.S. PATENT DOCUMENTS 5,083,312 1/1992 Newton et al. ..... 381/68

FOREIGN PATENT DOCUMENTS 5-115096 5/1993 Japan .

OTHER PUBLICATIONS

Ono, "Today's Digitally Hearing Aid Technology and Outlook for the Future", Japan Society of Acoustics, vol. 47, No. 10, (1991).

*Primary Examiner*—Sinh Tran
*Attorney, Agent, or Firm*—Foley & Lardner

[57] ABSTRACT

A digitally programmable hearing aid modifies a digital signal representative of a piece of talk and background noise by using hearing aid parameters, and the hearing aid parameters are transferred between the digitally programmable hearing aid and an external system in the form of acoustic signal so as to delete an electric connector from the digitally programmable hearing aid.

12 Claims, 11 Drawing Sheets

DIGITALLY PROGRAMMABLE HEARING AID COMMUNICABLE WITH EXTERNAL APPARATUS THROUGH ACOUSTIC SIGNAL

FIELD OF THE INVENTION

This invention relates to a hearing aid and, more particularly, to a digitally programmable hearing aid having hearing aid characteristics that are modifiable by changing parameters.

DESCRIPTION OF THE RELATED ART

A digital data processing technology has been applied to a hearing aid for optimizing the hearing aid characteristics. Such a digitized hearing aid is called a "digitally programmable hearing aid". The optimum hearing aid characteristics expected to the digitally programmable hearing aid are modifiable in dependence on the user, and the digitally programmable hearing aid changes the hearing aid characteristics through a fitting. The hearing aid characteristics are usually parametrized, and are varied by changing the parameters.

A typical example of the fitting system is disclosed in Japanese Patent Publication of Unexamined Application No. 5-115096, and FIG. 1 illustrates the prior art fitting system. The prior art fitting system largely comprises an audiometer 1*a* for a user 2 and a fitting apparatus 1*b* connectable to a digitally programmable hearing aid 3. The fitting apparatus 1*b* is connected through an interface 1*c* thereof to an interface 3*a* of the prior art digitally programmable hearing aid 3.

The audiometer 1*a* generates an audio tone widely variable in sound pressure, and the user informs of his or her minimum audible level and the discomfort level to the audiometer 1*a*. When the audiometer 1*a* decreases the sound pressure of the audio tone to the audible limit, the user informs the audiometer 1*a* that the sound pressure reaches the lower limit of his or her audible range, and the audiometer 1*a* determines the sound pressure to be the minimum audible level. On the other hand, when the user feels the audio tone discomfort, the user informs the audiometer 1*a* to reach the upper limit of the audible range, and the audiometer 1*a* determines the sound pressure to be the discomfort level. The minimum audible level and the discomfort level are representative of the auditory sense of the user 2, and are supplied to the fitting apparatus 1*b* as a digital auditory data signal DS1.

The fitting apparatus 1*b* is implemented by a personal computer system, and a digital data processing unit 1*d* and a keyboard 1*e* are incorporated in the fitting apparatus 1*b* together with the afore-mentioned interface 1*c*. Personal data information is informed from the keyboard 1*e* to the digital data processing unit 1*d*, and is, by way of example, user's name, age and environment where the user 2 mainly uses the digitally programmable hearing aid. The personal data information is transferred to the digital data processing unit 1*d* as a digital personal data signal DS2.

The digital data processing unit stores a data base in the memory unit thereof, and the data base contains fundamental characteristic data such as the loud characteristics of the hearing aid 3, influences of noise level and influence of talking level. When the digital auditory data signal DS1 and the digital personal data signal DS2 are supplied to the digital data processing unit 1*d*, the digital data processing unit 1*d* executes a program sequence so as to produce a set of parameters for optimizing the hearing aid characteristics.

The set of parameters are represented by a digital parameter signal DS3, and the digital data processing unit 1*d* supplies the digital parameter signal DS3 through the interface 1*c* to the prior art digitally programmable hearing aid 3. The set of parameters is stored in the prior art digitally programmable hearing aid 3, and the digitally programmable hearing aid 3 assists user's auditory sense through the optimum hearing aid characteristics.

The prior art digitally programmable hearing aid 3 has an output terminal 3*a*' connectable to a monitor screen 4, and the user 2 can confirm the optimized hearing aid characteristics on the monitor screen 4.

FIG. 2 illustrates a typical example of the prior art digitally programmable hearing aid disclosed in "Today's Digitally Hearing Aid Technology and Outlook for the Future", Japan Society of Acoustics, vol. 47, No. 10, 1991, pages 778 to 784.

The prior art digitally programmable hearing aid 3 comprises a microphone 3*b*, an analog-to-digital converter 3*c*, a digital signal processing unit 3*d* accompanied with a memory 3*e*, a digital-to-analog converter 3*f* and an earphone 3*g*. The microphone 3*b* generates an analog voice signal AS1 representative of voice and background noise, and supplies the analog voice signal AS1 to the analog-to-digital converter 3*c*. The analog-to-digital converter 3*c* converts the analog voice signal AS1 to a digital voice signal DS4, and supplies the digital voice signal DS4 to the digital signal processing unit 3*d*.

The fitting apparatus 1*b* supplies a set of parameters through the interface 3*a* to the memory 3*e*, and the set of parameters has been already stored in the memory 3*e*. The digital signal processing unit 3*d* carries out a digital signal processing on the digital voice signal DS4 in accordance with the hearing aid characteristics represented by the set of parameters, and supplies a digital audio signal DS5 to the digital-to-analog converter 3*f*.

The digital-to-analog converter 3*f* converts the digital audio signal DS5 to an analog audio signal AS2, and the supplies the analog audio signal AS2 to the earphone 3*g*. Then, the earphone 3*g* reproduces the voice, and the background noise is decreased.

Thus, the prior art digitally programmable hearing aid 3 assists user's auditory sense through the optimized hearing aid characteristics. As described hereinbefore, the prior art digitally programmable hearing aid 3 is required to communicate with the fitting apparatus 1*b* and the monitor screen 4 during the fitting, and the communication is carried out through the interfaces 3*a* and 3*a*'. However, the interfaces 3*a* and 3*a*' have respective connectors so as to connect cables for the digital parameter signal DS3 and a monitor signal to the interface circuits. Thus, the connectors are indispensable for the electric communication, and the connectors are exposed to the outside.

A first problem is inherently encountered in the prior art digitally programmable hearing aid 3 in that the water proof capability of the hearing aid tends to degrade during long service time. As a result, water damages the electric circuit incorporated in the prior art digitally programmable hearing aid.

The prior art digitally programmable hearing aid 3 further encounters a second problem in down-scaling. The second problem is also due to the connectors. Each of the connectors occupies a wide space, and is minimally scaled down. Even if the electric circuit is integrated on a small semiconductor chip, the two connectors do not allow a manufacturer to scale down the prior art digitally programmable hearing aid 3.

SUMMARY OF THE INVENTION

It is therefore an important object of the present invention to provide a digitally programmable hearing aid which is free from the damage due to the water and easily scaled down.

To accomplish the object, the present invention proposes to communicate through an acoustic coupler.

In accordance with one aspect of the present invention, there is provided a hearing aid communicable with an external apparatus for parameters defining at least hearing aid characteristics, comprising: a sound-to-electric signal converting means for generating a first electric signal representative of sound data information; a parameter memory for storing the parameters in a rewritable manner; a signal processing means connected to the voice-to-electric signal converting means and the parameter memory, and responsive to the parameters for generating a second electric signal representative of modified sound data information through a signal processing on the first electric signal; an electric signal-to-sound converting means connected to the signal processing means for generating a sound from the second electric signal; and a parameter transferring means connected between the parameter memory and one of the sound-to-electric signal converting means and the electric signal-to-sound converting means for transferring the parameter between an external apparatus and the aforesaid one of the sound-to-electric signal converting means and the electric signal-to-sound converting means in the form of an acoustic signal.

In accordance with another aspect of the present invention, there is provided a hearing aid connectable to an apparatus for supplying parameters representative of hearing aid characteristics, comprising: a voice-to-electric signal converting means for generating a first electric signal representative of voice data information; a voice reproducing means responsive to a second electric signal representative of modified voice data information for producing a voice; a memory means for storing the parameters; a signal processing means connected between the voice-to-electric signal converting means and the voice reproducing means, and responsive to the parameters for generating the second electric signal through a signal processing on the first electric signal; and an electric signal-to-acoustic signal converting means connected between the memory means and the voice reproducing means for generating an acoustic signal representative of the parameters.

In accordance with yet another aspect of the present invention, there is provided a hearing aid connectable to a fitting apparatus for receiving parameters representative of hearing aid characteristics, comprising: a sound-to-electric signal converting means for generating a first electric signal representative of voice data information and a second electric signal representative of the parameters; a voice reproducing means responsive to a third electric signal representative of modified voice data information for producing a voice; a memory means for storing the parameters in a rewritable manner; and a signal processing means connected between the sound-to-electric signal converting means and the voice reproducing means, and responsive to the parameters for generating the third electric signal through a signal processing on the first electric signal.

BRIEF DESCRIPTION OF THE DRAWINGS

The features and advantages of the digitally programmable hearing aid according to the present invention will be more clearly understood from the following description taken in conjunction with the accompanying drawings in which.

DESCRIPTION OF THE PREFERRED EMBODIMENTS

First Embodiment

Figure 1:
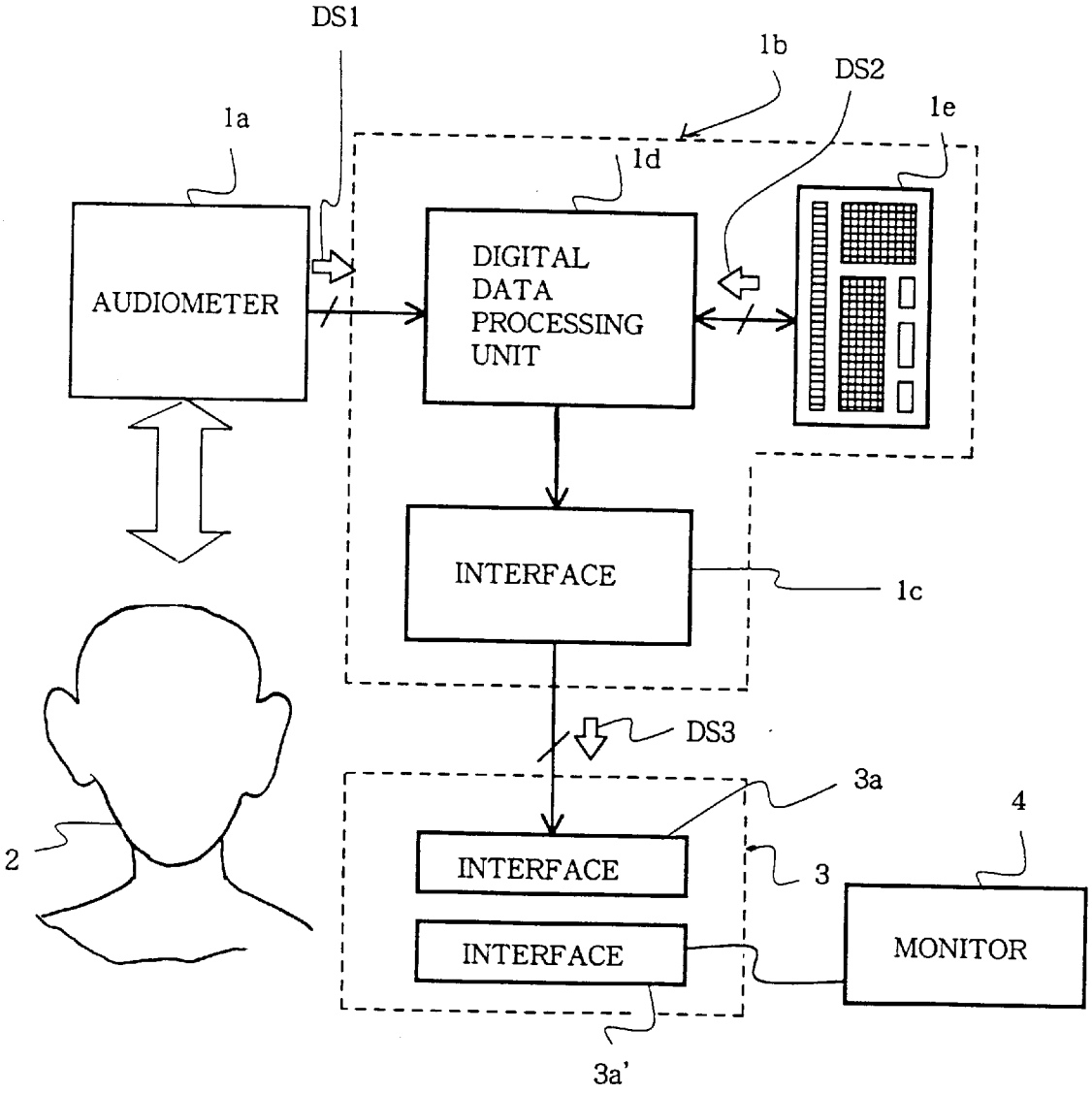
Fig. 1 PRIOR ART
FIG. 1 is a block diagram showing the prior art fitting system for the fitting.
Figure 2:
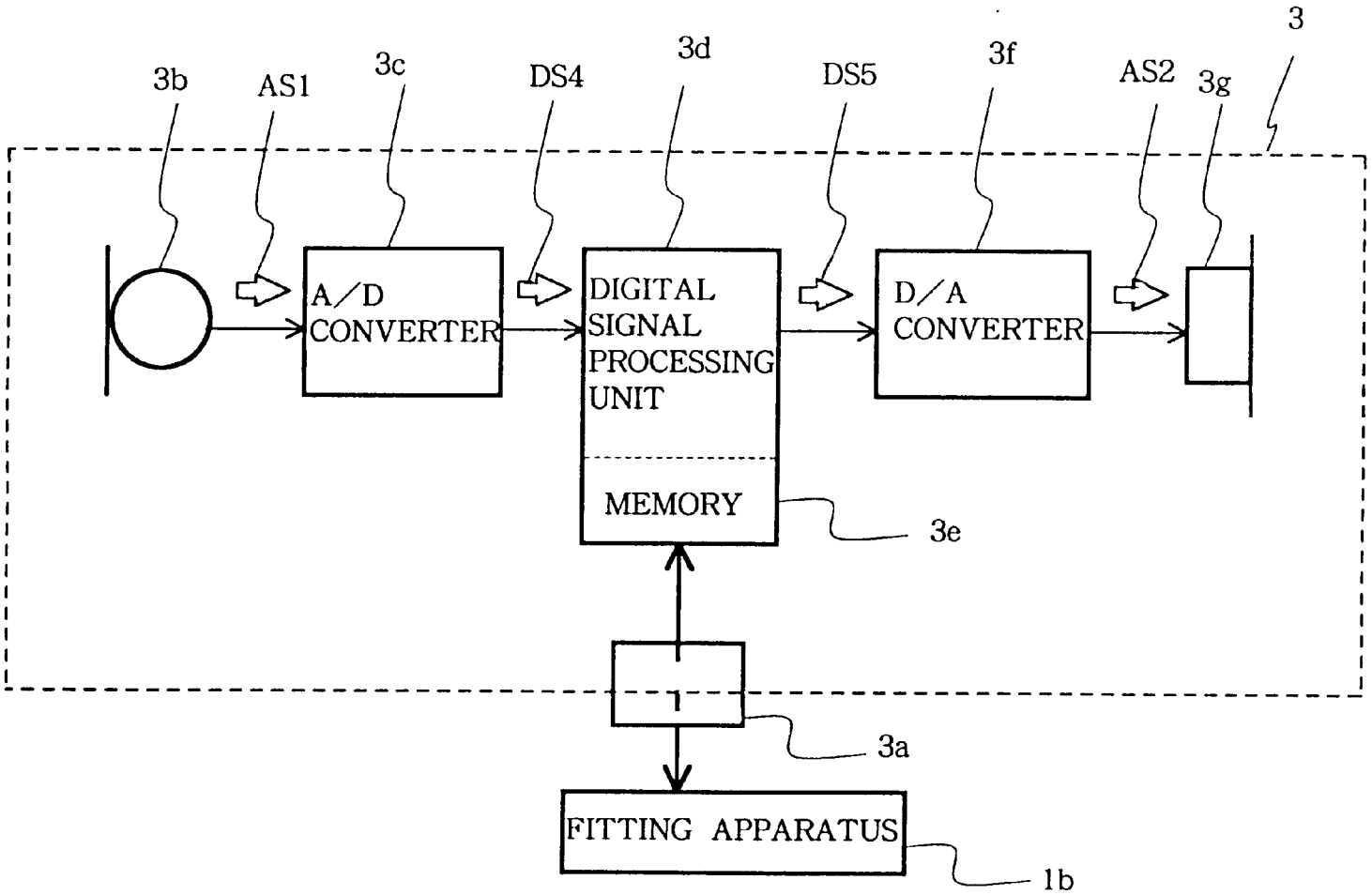
Fig. 2 PRIOR ART
FIG. 2 is a block diagram showing the circuit arrangement of the prior art digitally programmable hearing aid.
Figure 3:
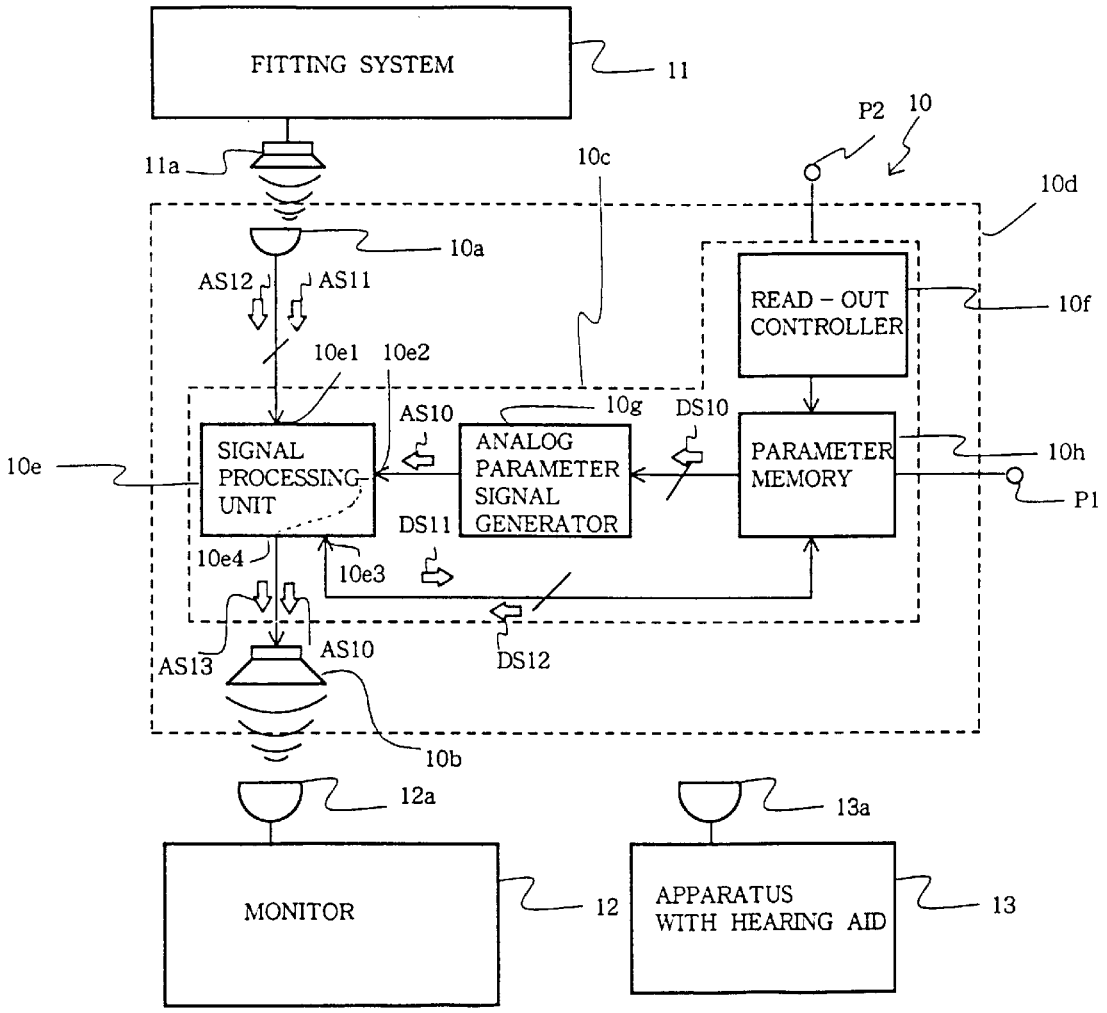
FIG. 3 is a block diagram showing the circuit arrangement of a digitally programmable hearing aid implementing the first embodiment of the present invention.

Referring to FIG. 3 of the drawings, a digitally programmable hearing aid 10 embodying the present invention is acoustically coupled to a fitting system 11 and a monitor 12. The fitting system 11 is similar to that of the prior art fitting system, and the fitting system 11 optimizes parametrized hearing aid characteristics for a particular user. The optimized hearing aid characteristics are displayed on a monitor 12, and the hearing aid parameters are acoustically transferred from the digitally programmable hearing aid 10 to the monitor 12.

The digitally programmable hearing aid 10 has a programming mode and an aiding mode. When the digitally programmable hearing aid 10 enters into the programming mode, a user optimizes the hearing aid characteristics through the fitting system 11, and the user conforms the optimized hearing aid characteristics on the monitor 12. On the other hand, while the digitally programmable hearing aid 10 is operating in the aiding mode, the digitally programmable hearing aid 10 assists user's auditory sense.

The digitally programmable hearing aid 10 comprises a microphone 10*a*, an earphone 10*b*, an electric circuit 10*c* connected between the microphone 10*a* and the earphone 10*b*, and a water-proof case 10*d* where the microphone 10*a*, the earphone 10*b* and the electric circuit 10*c* are accommodated.

The electric circuit 10*c* includes a signal processing unit 10*e*, a read-out controller 10*f*, an analog parameter signal generator 10*g* connectable to the earphone 10*b*, and a parameter memory 10*h* for storing device parameters.

The hearing aid parameters form parts of the device parameters, and other device parameters represent the mode of operation, program sequences and so forth. The device parameters for the operation mode cause the hearing aid to enter into a power-saving mode or a night mode for lowering sound pressure through a change of program sequence, by way example, and the change of program sequence can further modify the filtering characteristics of the signal processing unit. The operation mode, i.e., the programming mode or the aiding mode is specified by manipulating a switch P1 or applying an electric signal to a pin P1.

The read-out controller 10*f* is responsive to a read-out instruction given through a switch P2 or a pin P2 in the programming mode, and causes the parameter memory 10*h* to supply a digital parameter signal DS10 representative of the device parameters to the analog parameter signal generator 10*g*.

The analog parameter signal generator 10*g* forms an analog parameter signal AS10 from the digital parameter signal DS10, and the analog parameter signal AS10 is transferred through the signal processing unit 10*e* to the earphone 10*b*. The earphone 10*b* converts the analog parameter signal AS10 to an acoustic signal representative of the device parameters, and radiates the acoustic signal to the monitor 12 or an apparatus 13 with a digitally programmable hearing aid such as, for example, a telephone set, a television set, a radio receiver or a headphone stereo set.

The signal processing unit 10*e* includes an analog-to-digital converter, a digital-to-analog converter and a switching circuit selectively connecting signal ports 10*e*1, 10*e*2, 10*e*3 and 10*e*4 depending upon the operation mode, and digitally processes signals in accordance with the hearing aid parameters. Such a signal processing unit 10*e* is known to a person skilled in the art, and no further description is incorporated hereinbelow.

The digitally programmable hearing aid 10 behaves as follows. Assuming now that a user wants to optimize the hearing aid characteristics. The user communicates with the fitting system 11 as similar to the fitting for the prior art digitally programmable hearing aid, and optimizes the hearing aid characteristics. The fitting system 11 radiates an acoustic signal representative of the hearing aid parameters from an electroacoustic transducer 11*a* to the microphone 10*a*. The programming mode is established in the digitally programmable hearing aid 10, and an analog parameter signal AS11 representative of the optimized hearing aid parameters is supplied from the microphone 10*a* to the signal processing unit 10*e*. The signal processing unit 10*e* converts the analog parameter signal AS11 to a digital parameter signal DS11, and supplies the digital parameter signal DS11 to the parameter memory 10*h*. The parameter memory 10*h* extracts the optimized hearing aid parameters from the digital parameter signal DS11, and stores therein.

When the user wants to visually confirm the optimized hearing aid parameters, the user instructs the read-out controller 10*f* to read out the device parameters, and the parameter memory 10*h* supplies the digital parameter signal DS10 under the control of the read-out controller 10*f*. As described hereinbefore, the digital parameter signal DS10 is converted into the analog parameter signal AS10, and the earphone 10*b* radiates the acoustic parameter signal representative of the optimized hearing aid parameters to the microphone 12*a* of the monitor 12. The monitor 12 extracts the hearing aid parameters, and visually displays the optimized hearing aid characteristics.

On the other hand, if the user wants to transfer the optimized hearing aid parameters to the apparatus 13, a microphone 13*a* of the apparatus 13 is opposed to the earphone 10*b*, and instructs the read-out controller 10*f* to read out the device parameters from the parameter memory 10*h*. The device parameters are acoustically transferred from the earphone 10*b* to the microphone 13*a*, and the user can listen to speech or music without the digitally programmable hearing aid 10.

When the digitally programmable hearing aid 10 enters into the hearing aid mode, the user's auditory sense is assisted by the digitally programmable hearing aid 10. Voice or sound is caught by the microphone 10*a* together with background noise, and the microphone 10*a* supplies an analog voice signal AS12 representative of the voice/sound and the background noise to the signal processing unit 10*e*. The signal processing unit 10*e* converts the analog voice signal AS12 to a digital voice signal, and processes the digital voice signal in accordance with the hearing aid parameters contained in a digital parameter signal DS12. The contents of the digital voice signal is modified, and the background noise may be decreased so as to make the voice clear. The digital-to-analog converter generates an analog voice signal AS13, and supplies the analog voice signal AS13 to the earphone 10*b*. The earphone reproduces the voice for the user.

As will be understood from the foregoing description, the digitally programmable hearing aid according to the present invention acoustically communicates with the fitting system 11 and the monitor/other apparatus 12/13, and a connector is not required for the parameter signals. For this reason, the manufacturer scales down the digitally programmable hearing aid 10, and improves the water-proof capability.

Second Embodiment

Figure 4:
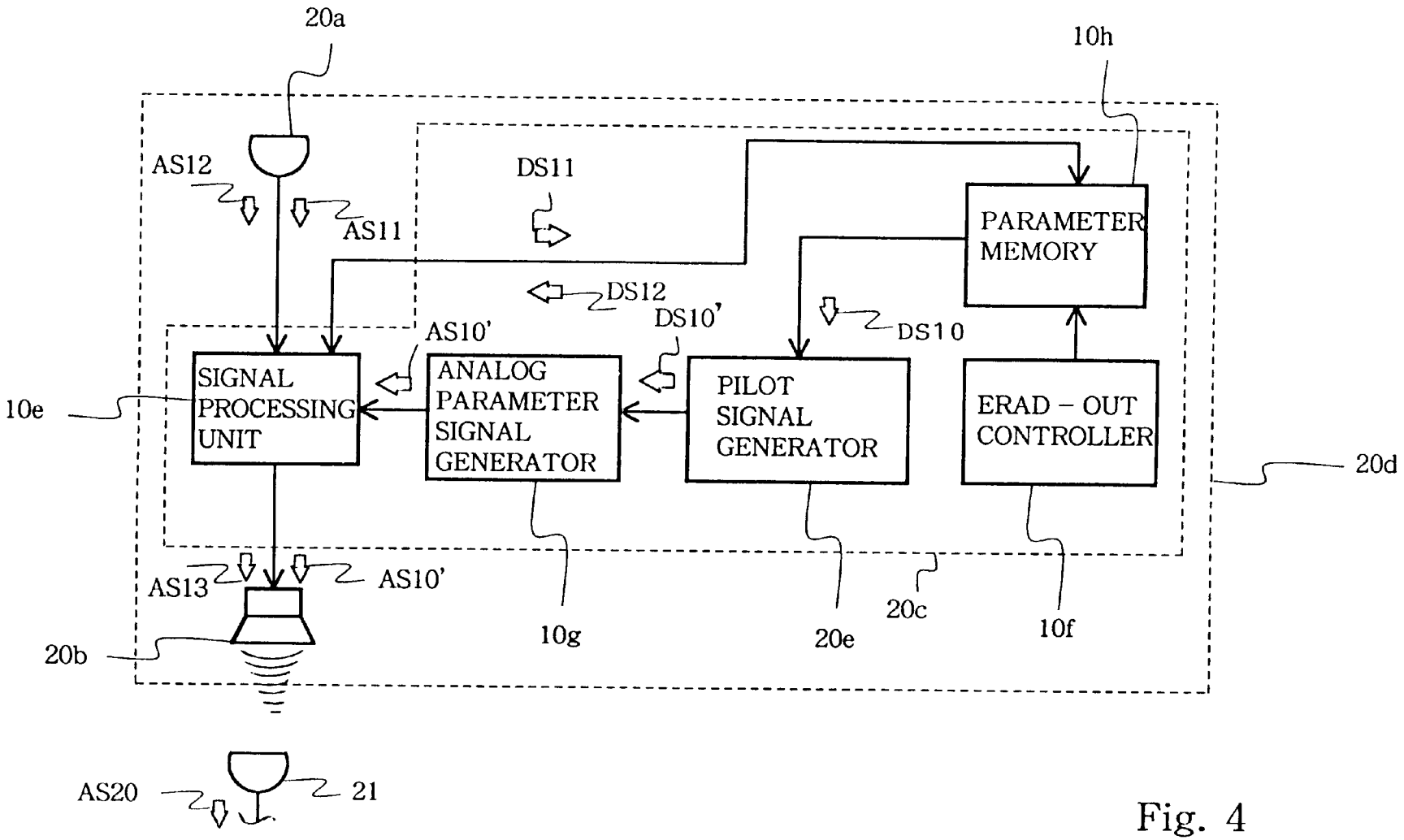
FIG. 4 is a block diagram showing the circuit arrangement of a digitally programmable hearing aid implementing the second embodiment of the present invention.

Turning to FIG. 4 of the drawings, another digitally programmable hearing aid embodying the present invention also largely comprises a microphone 20*a*, an earphone 20*b*, an electric circuit 20*c* and a water-proof case 20*d*, and has the programming mode and the aiding mode.

The electric circuit 20*c* is similar to the electric circuit 10*c* except for a plot signal generator 20*e*. For this reason, the other circuit components are labeled with the same references designating corresponding circuit components of the electric circuit 10*c* without detailed description.

The pilot signal generator 20*e* generates a pilot code representative of the device parameters, and adds the pilot code to the digital parameter signal DS10. The analog parameter signal generator 10*g* converts the digital parameter signal DS10' with the pilot code to an analog parameter signal AS10'. The analog parameter signal AS10' contains a piece of pilot information, and is supplied through the signal processing unit 10*e* to the earphone 20*b*.

The earphone 20*b* converts the analog parameter signal AS10' to an acoustic parameter signal, and the acoustic parameter signal is radiated to a microphone 21. The microphone 21 converts the acoustic parameter signal to an analog parameter signal AS20. A signal processing unit connected to the microphone 21 easily discriminates the parameter signal from a voice signal by virtue of the pilot information. For this reason, the apparatus 13 enters into a programming mode when discriminating the pilot code.

The digitally programmable hearing aid implementing the second embodiment achieves all the advantages of the first embodiment.

Third Embodiment

Figure 5:
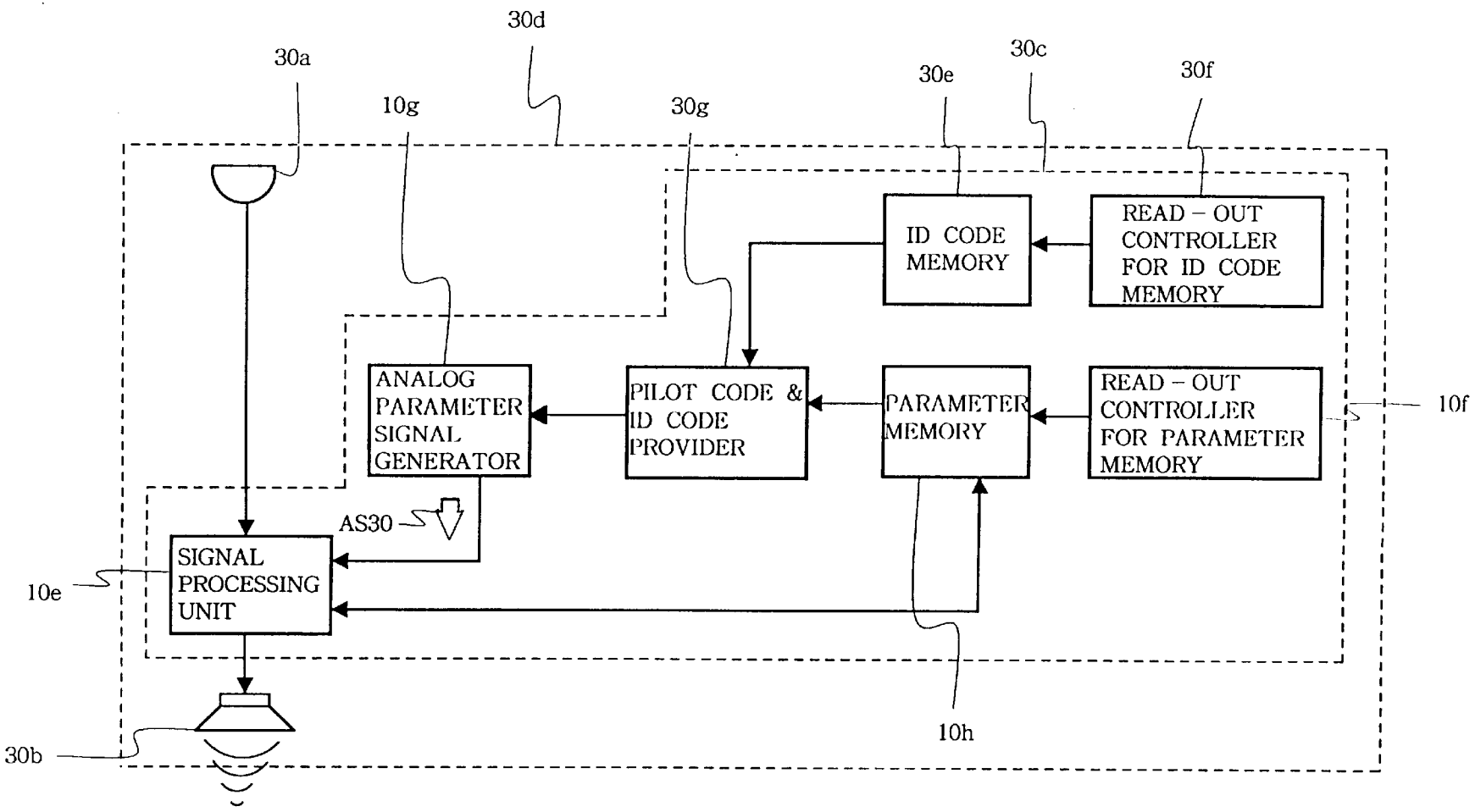
FIG. 5 is a block diagram showing the circuit arrangement of a digitally programmable hearing aid implementing the third embodiment of the present invention.

Turning to FIG. 5 of the drawings, yet another digitally programmable hearing aid embodying the present invention also largely comprises a microphone 30*a*, an earphone 30*b*, an electric circuit 30*c* and a water-proof case 30*d*, and has the programming mode and the aiding mode.

The electric circuit 20*c* is similar to the electric circuit 10*c* except for an identity code memory 30*e*, a read-out controller for identity code memory 30*f* and a pilot code and identity code provider 30*g*. For this reason, the other circuit components are labeled with the same references designating corresponding circuit components of the electric circuit 10*c* without detailed description.

The identify code memory 30*e* stores an identity code assigned to the digitally programmable hearing aid, and supplies the identity code to the pilot code and identity code provider 30*g* under the control of the read-out controller 30*f* for the identity code memory. The pilot code and identity code provider 30*g* not only generates the pilot code as similar to the pilot signal generator 20*e* but also adds the pilot code and the identity code to the string of parameters supplied from the parameter memory 10*h*. The analog parameter signal generator 10*g* converts the pilot code, the identity code and the parameters to an analog signal AS30, and the analog signal AS30 is transferred through the signal processing unit 10*e* to the earphone 30*b*. The earphone 30*b* converts the analog signal AS30 to an acoustic signal representative of the pilot code, the identity code and the parameters, and supplies the acoustic signal to the monitor 12 or the apparatus 13.

The microphone (not shown) of the monitor 12 or the apparatus 13 converts the acoustic signal to an analog signal representative of the pilot code, the identity code and the parameters. Thus, the monitor 12 or the apparatus 13 discriminates the acoustic signal representative of the identity code and the parameters from sounds by virtue of the pilot code and the source of parameters, i.e., the hearing aid from other source through the identity code.

The advantages of the first embodiment are achieved by the digitally programmable hearing aid implementing the third embodiment. Only the identity code may be added to the parameters.

Fourth Embodiment

Figure 6:
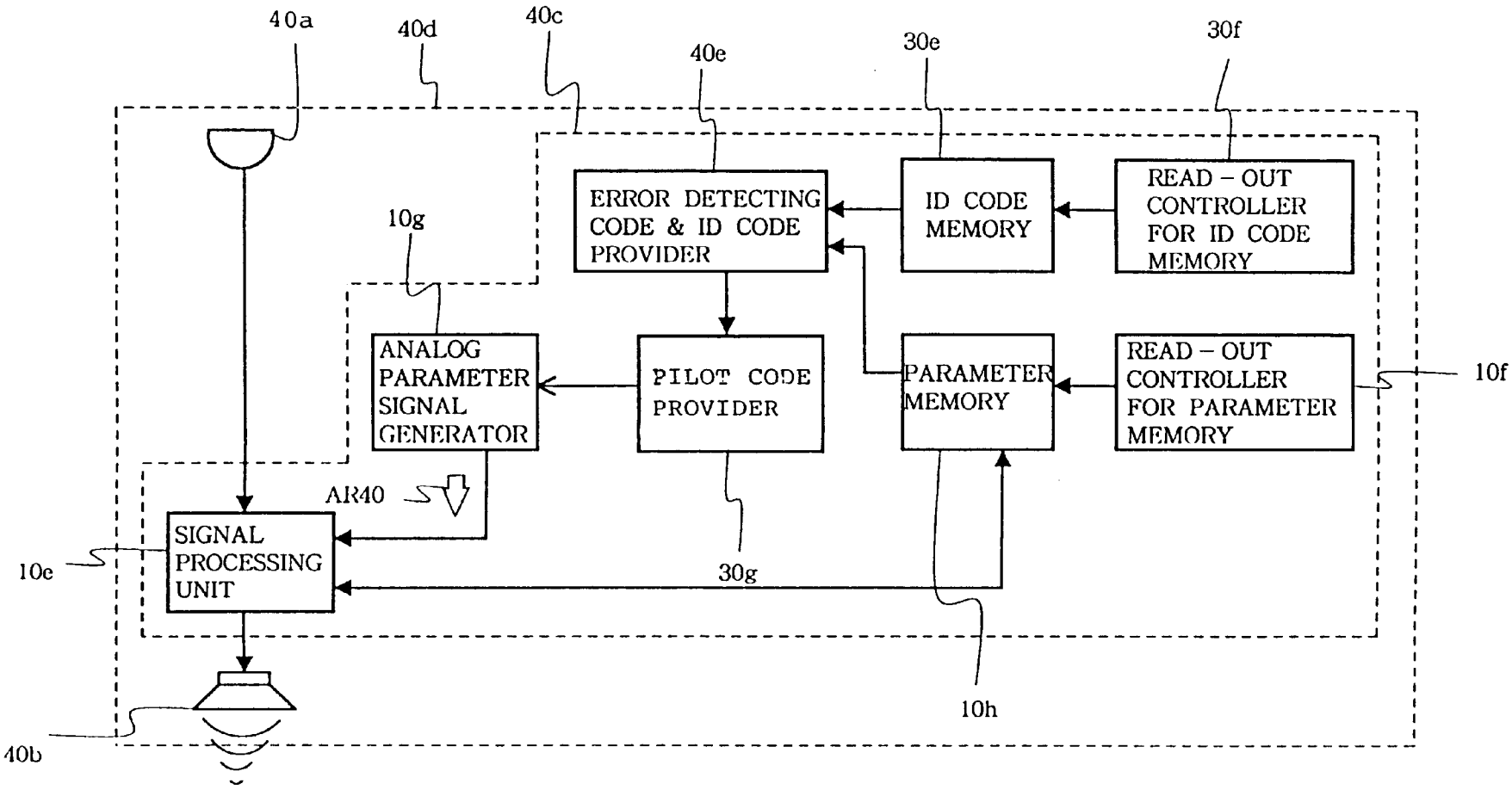
FIG. 6 is a block diagram showing the circuit arrangement of a digitally programmable hearing aid implementing the fourth embodiment of the present invention.

Turning to FIG. 6 of the drawings, yet another digitally programmable hearing aid embodying the present invention also largely comprises a microphone 40*a*, an earphone 40*b*, an electric circuit 40*c* and a water-proof case 40*d*, and has the programming mode and the aiding mode.

The electric circuit 40*c* is similar to the electric circuit 30*c* except for an error detecting code provider 40*e*. For this reason, the other circuit components are labeled with the same references designating corresponding circuit components of the electric circuit 30*c* without detailed description.

The error detecting code provider 40*e* generates an error detecting code, and adds the error detecting code and the identity code supplied from the identity code memory 30*e* to the string of parameters. The pilot code provider 30*g* further adds the pilot code to the string of parameters, and the analog parameter signal generator 10*g* coverts the pilot code, the identity code, the error detecting code and the parameters to an analog signal AR40. The analog signal AR40 is similarly converted to an acoustic signal, and the acoustic signal is supplied to the monitor 12 or the apparatus 13. The error detecting code prevents the monitor 12 or the apparatus 13 from malfunction.

The digitally programmable hearing aid implementing the fourth embodiment achieves all the advantages of the first embodiment. An error correcting code may be added to the string of parameters. When the parameters are stored in the parameter memory 10*h*, the fitting system may add an error detecting code or an error correcting code to the parameters so as to store the error detecting code or the error correcting code together with the parameters.

Fifth Embodiment

Figure 7:
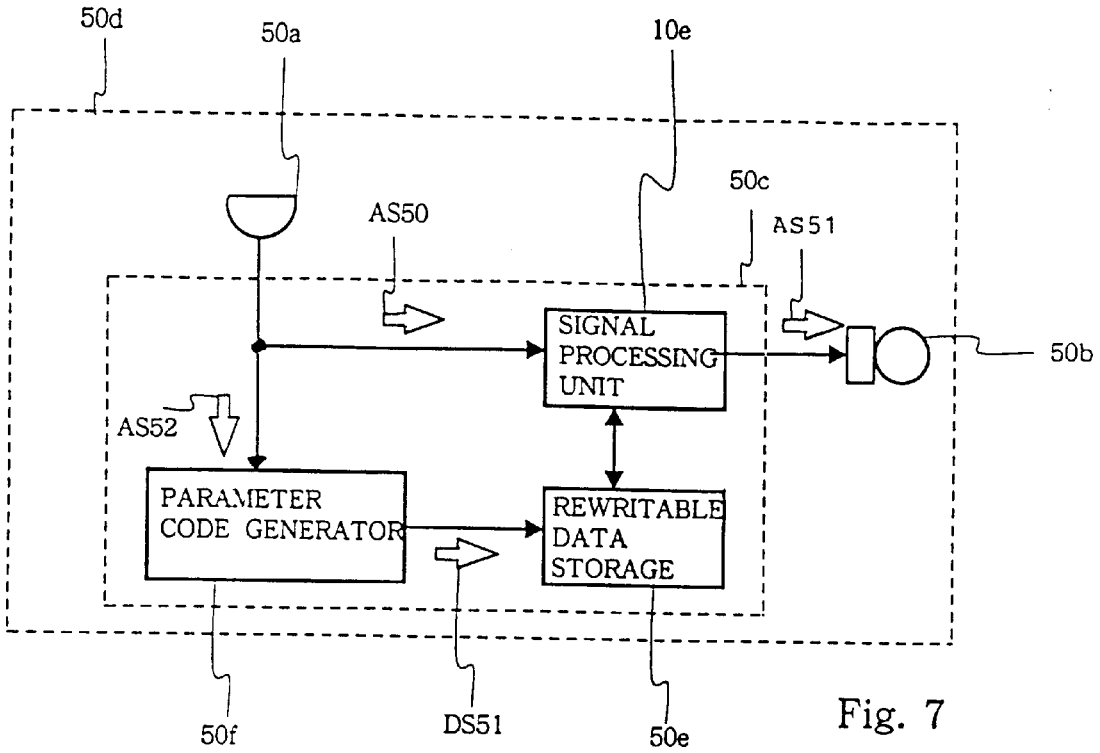
FIG. 7 is a block diagram showing the circuit arrangement of a digitally programmable hearing aid implementing the fifth embodiment of the present invention.

Turning to FIG. 7 of the drawings, yet another digitally programmable hearing aid embodying the present invention largely comprises a microphone 50*a*, an earphone 50*b*, an electric circuit 50*c* and a water-proof case 50*d*. The electric circuit 50*c* includes the signal processing unit 10*e*. A rewritable data storage 50*e* and a parameter code generator 50*f* are further incorporated in the electric circuit 50*c*. A set of parameters is previously stored in the rewritable data storage 50*e*.

While the digitally programmable hearing aid is assisting a user, the microphone 50*a* catches voice and sounds, and converts the voice and the sounds to an analog signal AS50. The analog signal AS50 is supplied to the signal processing unit 10*e*, and the signal processing unit 10*e* firstly converts the analog signal AS50 to a digital signal. The rewritable data storage 50*e* supplies the hearing aid parameters to the signal processing unit 10*e*, and the signal processing unit 10*e* treats the voice/sound information of the digital signal with the hearing aid parameters. The digital signal treated with the hearing aid parameters is converted to an analog signal AS51, and the microphone 50*b* produces the voice and the sound from the analog signal AS51. Thus, the parameter code generator 50*f* stands idle during the hearing aid.

When the hearing aid parameters are changed, a new set of hearing aid parameters, an instruction data code and instruction program codes are changed to an acoustic signal by a suitable apparatus, and the acoustic signal is supplied to the microphone 50*a*. The microphone 50*a* converts the acoustic signal to an analog signal AS52 representative of the set of hearing aid parameters, the instruction data code and the instruction program codes, and the analog signal AS52 is converted to a digital signal DS51. The digital signal DS51 is transferred to a rewritable data storage 50*e*, and the set of hearing aid parameters is replaced with the new set of hearing aid parameters. While a user is changing the set of hearing aid parameters, the signal processing unit 10*e* may not respond to the analog signal AS52.

The set of parameters is transferred to the digitally programmable hearing aid implementing the fifth embodiment in the form of acoustic signal, and no electric connector is required for the communication with the fitting system. Thus, the digitally programmable hearing aid achieves a long durability, and a manufacturer can scale down the digitally programmable hearing aid.

Sixth Embodiment

Figure 8:
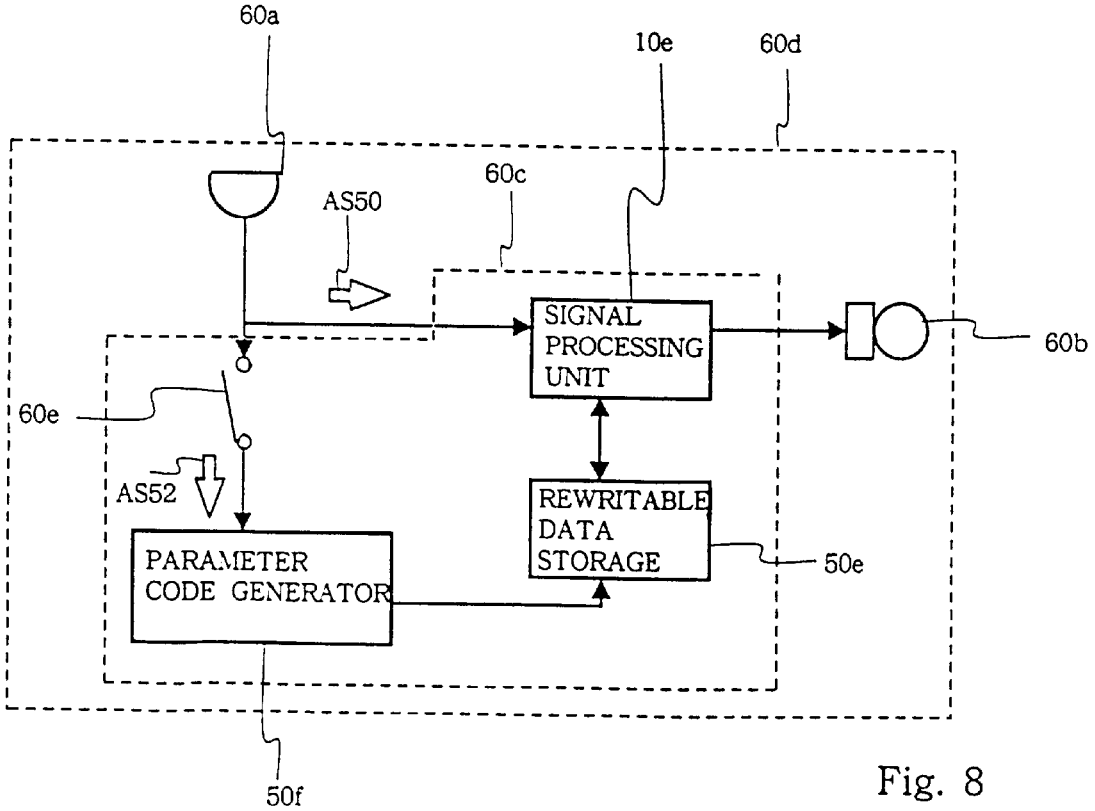
FIG. 8 is a block diagram showing the circuit arrangement of a digitally programmable hearing aid implementing the sixth embodiment of the present invention.

Turning to FIG. 8 of the drawings, yet another digitally programmable hearing aid implementing the present invention also largely comprises a microphone 60*a*, an earphone 60*b*, an electric circuit 60*c* and a water-proof case 60*d*. The electric circuit 60*c* is similar to the electric circuit 50*c* except for a switching element 60*e*. For this reason, the other circuit components are labeled with the same references as those of the fifth embodiment without detailed description.

The switching element 60*e* is manipulated such that the analog signal representative of the parameters and other codes reaches the parameter code generator 50*f*, and the parameter code generator 50*f* is not expected to discriminate the analog signal AS52 from the analog signal AS50. The digitally programmable hearing aid achieves all the advantages of the fifth embodiment.

Seventh Embodiment

Figure 9:
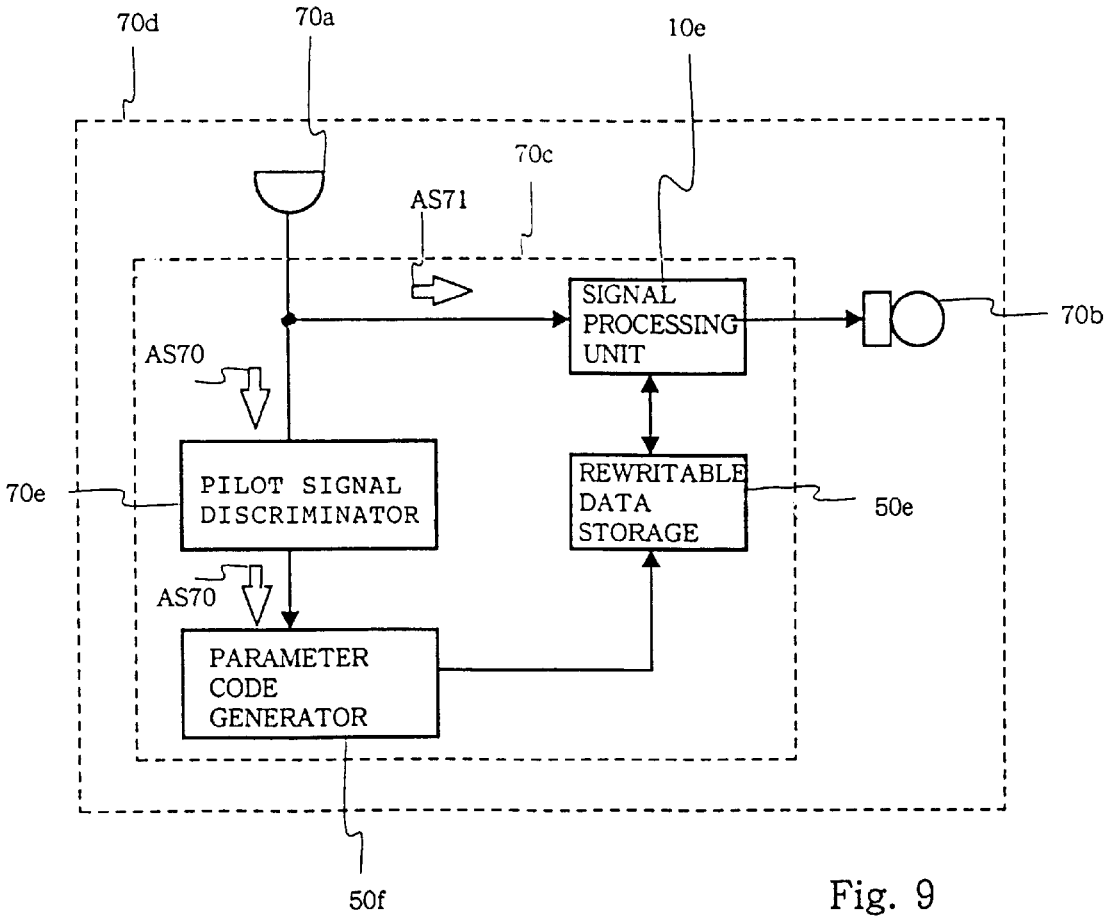
FIG. 9 is a block diagram showing the circuit arrangement of a digitally programmable hearing aid implementing the seventh embodiment of the present invention.

Turning to FIG. 9 of the drawings, yet another digitally programmable hearing aid embodying the present invention largely comprises a microphone 70*a*, an earphone 70*b*, an electric circuit 70*c* and a water-proof case 70*d*. The electric circuit is similar to the electric circuit 60*c* except for a pilot signal discriminator 70*e*, and, for this reason, the other circuit components are labeled with the references designating corresponding components of the sixth embodiment without detailed description.

In this instance, the parameters are supplied from a fitting apparatus (not shown) in the form of an acoustic signal, and an acoustic pilot signal is added to the acoustic parameter signal. The microphone 70*a* converts the acoustic pilot signal and the acoustic parameter signal to an analog signal AS70, and the pilot signal discriminator 70*e* transfers the analog signal AS70 to the parameter code generator 50*f*. However, the pilot signal discriminator 70*e* does not transfer an analog signal AS71 representative of voice and sound to the parameter code generator 50*f*, because the analog signal AS71 is never accompanied with the pilot signal. Only the signal processing unit 10*e* responds to the analog signal 10*e*. Thus, the analog signals AS70 and AS71 are automatically steered to the parameter code generator 50*f* and the signal processing unit 10*e* without the switching element 60*e*.

The digitally programmable hearing aid implementing the seventh embodiment communicates with the fitting system without an electric connector, For this reason, the digitally programmable hearing aid is free from the trouble due to breakage of the water proof of the electric connector, and a manufacturer scales down the digitally programmable hearing aid. Moreover, while the digitally programmable hearing aid is assisting a user, the user may change the hearing aid parameters by supplying the acoustic parameter signal together with the acoustic pilot signal.

Eighth Embodiment

Figure 10:
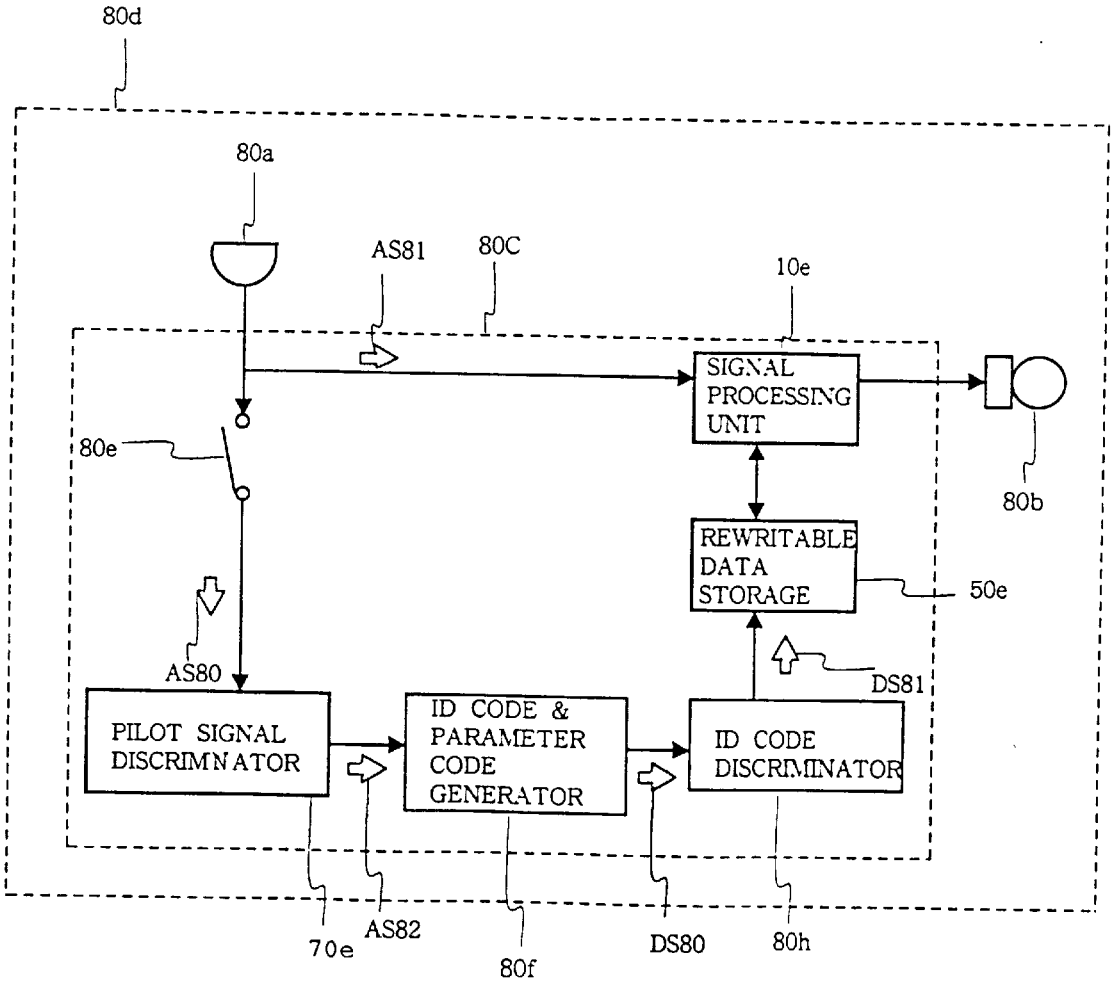
FIG. 10 is a block diagram showing the circuit arrangement of a digitally programmable hearing aid implementing the eighth embodiment of the present invention.

Turning to FIG. 10 of the drawings, a digitally programmable hearing aid embodying the present invention largely comprises a microphone 80*a*, an earphone 80*b*, an electric circuit 80*c* and a water-proof case 80*d*. A switching element 80*e*, an identity code and parameter code generator 80*f* and an identity code discriminator 80*h* are added to the electric circuit 70*c*. The other circuit components are similar to those of the electric circuit 70*c*, and, for this reason, are labeled with the same references as the corresponding circuit components of the electric circuit 70*c*.

The electric switch 80*e* isolates the pilot signal discriminator 70*e* from the microphone 80*a* in the aiding mode. However, when the electric switch 80*e* connects the microphone 80*a* to the pilot signal discriminator 70*e*, the digitally programmable hearing aid enters into the programming mode, and allows a user to change the hearing aid characteristics.

The parameters are supplied from a fitting apparatus (not shown) to the microphone 80*a* in the form of acoustic signal together with a pilot signal and an identity signal. The microphone 80*a* converts the acoustic pilot signal, the acoustic identity signal and the acoustic parameter signal to an analog signal AS80, and is transferred through the electric switch 80*e* to the pilot signal discriminator 70*e*. The pilot signal discriminator 70*e* discriminates the analog signal AS80 from an analog signal AS81 representative of voice and sound, and transfers an analog signal AS82 representative of the identity information and the parameter information to the identity code and parameter code generator 80*f*. The analog signal AS82 is converted to a digital signal DS80 which contains an identity code and a parameter code. The identity code discriminator 80*h* checks the identity code to see whether or not the identity code is matched with the identity code assigned to the digitally programmable hearing aid. When the identity codes are matched with each other, the identity code discriminator 80*h* transfers the parameter code to the rewritable data storage 50*e* so as to modify the hearing aid parameters.

Thus, the pilot signal discriminator 70*e* does not allow the hearing aid parameters to be mistakenly modified due to noise, and the identity code discriminator 80*h* further prevents the hearing aid parameters from destruction due to parameters for another digitally programmable hearing aid.

One of the switching element 80*e* and the pilot signal discriminator 70*e* may be deleted from the electric circuit 80*c*.

Ninth Embodiment

Figure 11:
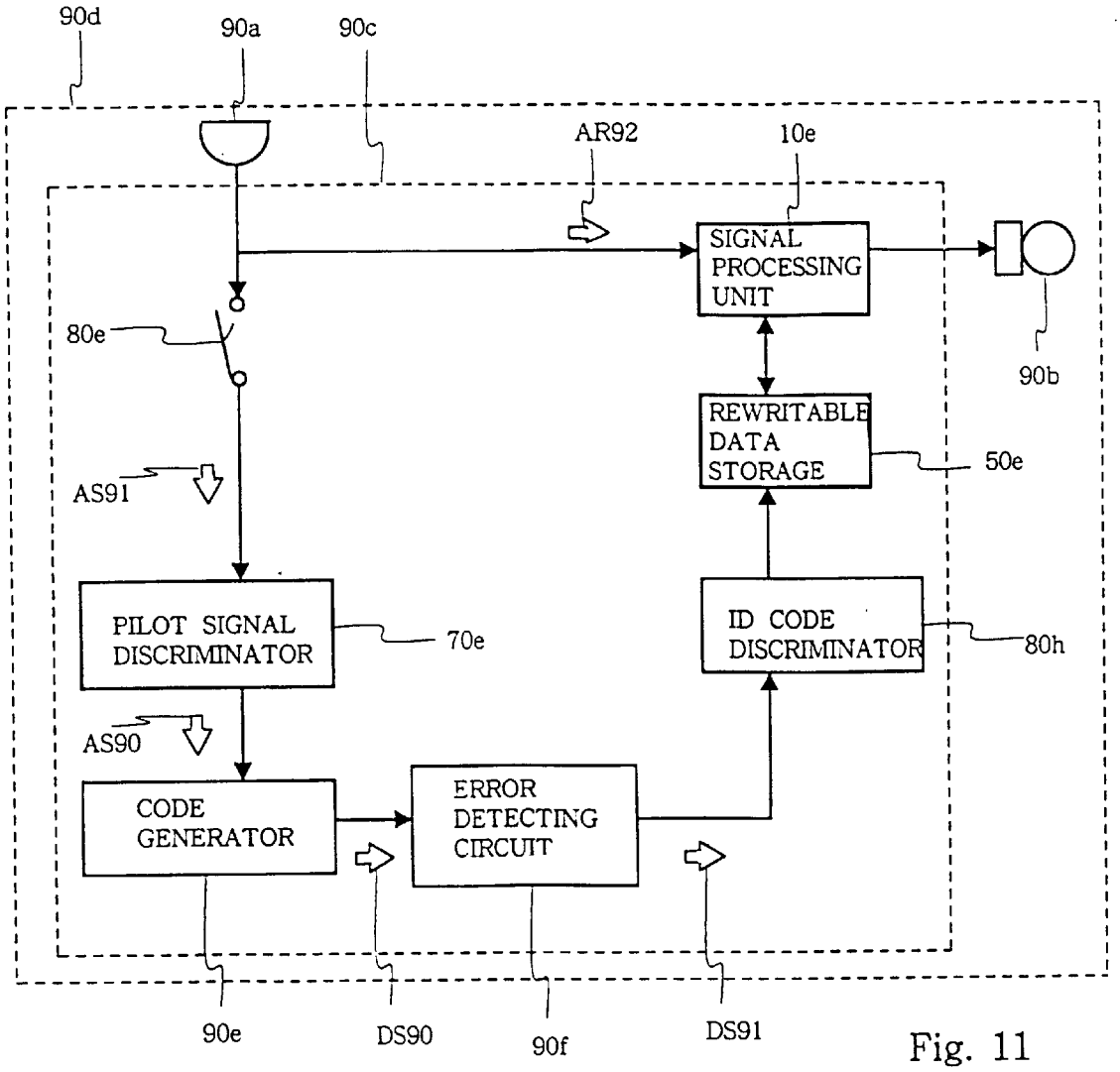
FIG. 11 is a block diagram showing the circuit arrangement of a digitally programmable hearing aid implementing the ninth embodiment of the present invention.

Turning to FIG. 11 of the drawings, a digitally programmable hearing aid embodying the present invention largely comprises a microphone 90*a*, an earphone 90*b*, an electric circuit 90*c* and a water-proof case 90*d*. The electric circuit 90*c* is similar to the electric circuit 80*c* except for a code generator 90*e* and an error detecting circuit 90*f*, and, for this reason, the other circuit components are labeled with the same references as those of the electric circuit 80*c*.

The code generator 90*e* generates an identity code, an error detecting code and a parameter code from an analog signal AS90, and the error detecting code 90*f* checks the error detecting code to see whether or not an error bit is introduced in the parameter code. When the error bit was found, the error detecting circuit 90*f* may generate an error signal so as to inform the detection of the error bit to a user.

The electric switch 80*e* isolates the pilot signal discriminator 70*e* from the microphone 80*a* in the aiding mode. However, when the electric switch 80*e* connects the microphone 80*a* to the pilot signal discriminator 70*e*, the digitally programmable hearing aid enters into the programming mode, and allows a user to change the hearing aid characteristics.

The parameters are supplied from a fitting apparatus (not shown) to the microphone 80*a* in the form of acoustic signal together with a pilot signal, an identity signal and an error detecting signal. The microphone 80*a* converts the acoustic pilot signal, the acoustic identity signal, the acoustic parameter signal and the acoustic error detecting signal to an analog signal AS91, and is transferred through the electric switch 80*e* to the pilot signal discriminator 70*e*. The pilot signal discriminator 70*e* discriminates the analog signal AS91 from an analog signal AS92 representative of voice and sound, and transfers the analog signal AS90 to the code generator 80*f*. The analog signal AS90 is converted to a digital signal DS90 which contains the identity code, the parameter code and the error detecting code. If the error detecting circuit 90*f* confirms that no error bit has not been introduced, the error detecting circuit 90*f* supplies a digital signal DS91 containing the identity code and the parameter code to the identity code discriminator 80*h*. The identity code discriminator 80*h* checks the identity code to see whether or not the identity code is matched with the identity code assigned to the digitally programmable hearing aid. When the identity codes are matched with each other, the identity code discriminator 80*h* transfers the parameter code to the rewritable data storage 50*e* so as to modify the hearing aid parameters.

Thus, the pilot signal discriminator 70*e* does not allow the hearing aid parameters to be mistakenly modified due to noise, the error detecting circuit 90*f* enhances the reliability of the parameters, and the identity code discriminator 80*h* prevents the hearing aid parameters from destruction due to parameters for another digitally programmable hearing aid.

One of the switching element 80*e* and the pilot signal discriminator 70*e* may be deleted from the electric circuit 80*c*, and the error detecting circuit 90*e* may be replaced with an error correcting circuit.

Tenth Embodiment

Figure 12:
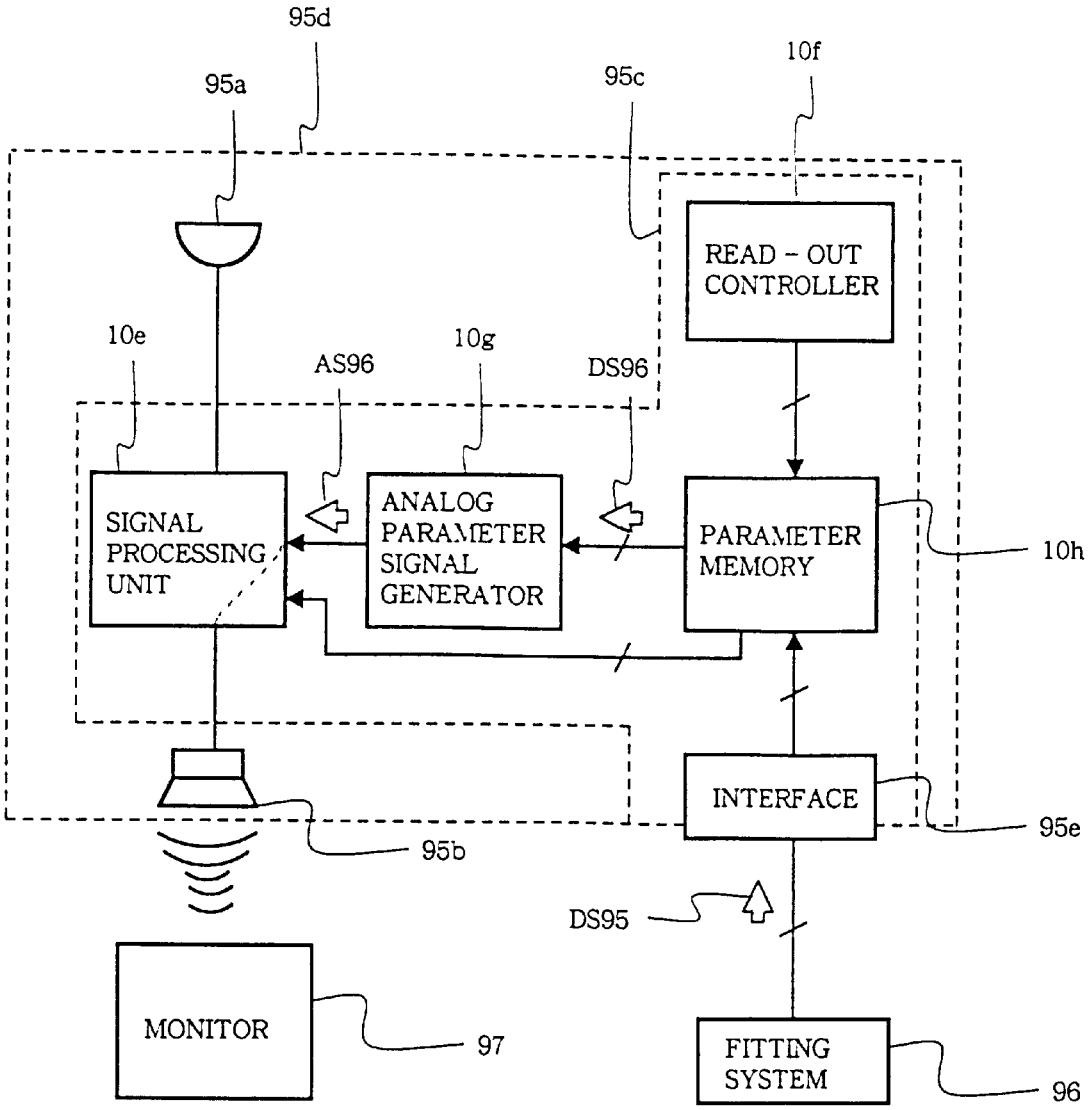
FIG. 12 is a block diagram showing the circuit arrangement of a digitally programmable hearing aid implementing the tenth embodiment.

Turning to FIG. 12 of the drawings, a digitally programmable hearing aid embodying the present invention largely comprises a microphone 95*a*, an earphone 95*b*, an electric circuit 95*c* and a water-proof case 95*d*. The references used in FIG. 3 designate circuit components corresponding to those of the electric circuit 10*c*.

The electric circuit 95*c* receives a digital parameter signal 95 from a fitting system 96 through an interface 95*e*, and the interface 95*e* supplies the parameters to the parameter memory 10*h*. Thus, the new parameters are supplied to the digitally programmable hearing aid in the form of electric signal.

However, when a user requests the read-out controller 10*f* to read out the parameters, the parameter memory 10*h* supplies a digital signal DS96 representative of the parameters to the analog parameter signal generator 10*g*. The analog parameter signal generator 10*g* converts the digital signal DS96 to an analog parameter signal AS96, and the analog parameter signal AS96 is supplied through the signal processing unit 10*e* to the earphone 95*b*. The earphone 95*b* converts the analog parameter signal AS96 to an acoustic signal, and the acoustic signal is, by way of example, transferred to a monitor 97.

Thus, the digitally programmable hearing aid communicates with the monitor 97 or an audio system through the acoustic signal, and a connector is not necessary for the communication with the external apparatus.

As will be appreciated from the foregoing description, the digitally programmable hearing aid according to the present invention communicates with the fitting system and/or the monitor/external apparatus through an acoustic signal, and a connector for an electric signal is deleted therefrom. This results in a scaling-down and improvement in water-proof capability of the case.

Although particular embodiments of the present invention have been shown and described, it will be obvious to those skilled in the art that various changes and modifications may be made without departing from the spirit and scope of the present invention.

For example, the earphone may be replaced with a small loud speaker. A suitable electric signal-to-acoustic signal converter independent from an earphone may be connected to the analog parameter signal converter.

What is claimed is:

1. A hearing aid connectable to an apparatus for supplying parameters representative of hearing aid characteristics, comprising:

a voice-to-electric signal converter configured to generate a first electric signal representative of voice data information;

a voice reproducer responsive to a second electric signal representative of modified voice data information and configured to produce a voice;

a memory configured to store said parameters;

a signal processor connected between said voice-to-electric signal converter and said voice reproducer, and responsive to said parameters to generate said second electric signal through a signal processing on said first electric signal; and an electric signal-to-acoustic signal converting means connected between said memory and said voice reproducer for generating an acoustic signal representative of said parameters, in which said memory stores said parameters representative of said hearing aid characteristics as a part of a digital code, and said electric signal-to-acoustic signal converting means includes, a read-out controller connected to said memory and configured to cause said memory to output said digital code, an analog parameter signal generator connected to said memory and configured to convert said digital code to a first analog signal, and an acoustic signal generator connected to said analog-parameter signal generator and responsive to said first analog signal to generate said acoustic signal, wherein said read-out controller is responsive to an externally-received signal to cause said memory to output said digital code.

2. The hearing aid as set forth in claim 1, in which said voice reproducer and said acoustic signal generator are implemented by an earphone.

3. The hearing aid as set forth in claim 1, in which said electric signal-to-acoustic signal converting means further includes a pilot signal generator connected between said memory and said analog parameter signal generator and generating a pilot sub-code representing that said digital code contains said parameters for adding said pilot sub-code to said digital code, wherein said analog parameter signal generator converts said pilot sub-code and said digital code to said first analog signal, wherein said first analog signal is processed by said signal processor and output as said acoustic signal by said acoustic signal generator, and wherein said pilot sub-code is extracted from said acoustic signal by an external device to ascertain whether or not said acoustic signal represents said parameters.

4. The hearing aid as set forth in claim 3, in which said electric signal-to-acoustic signal converting means further includes an identity code generator configured to store an identity code assigned to said hearing aid for adding said identity code to said digital code.

5. A hearing aid connectable to an apparatus for supplying parameters representative of hearing aid characteristics, comprising:

a voice-to-electric signal converter configured to generate a first electric signal representative of voice data information;

a voice reproducer responsive to a second electric signal representative of modified voice data information and configured to produce a voice;

a memory configured to store said parameters;

a signal processor connected between said voice-to-electric signal converter and said voice reproducer, and responsive to said parameters to generate said second electric signal through a signal processing on said first electric signal; and an electric signal-to-acoustic signal converting means connected between said memory and said voice reproducer for generating an acoustic signal representative of said parameters, in which said memory stores said parameters representative of said hearing aid characteristics as a part of a digital code, and said electric signal-to-acoustic signal converting means includes, a read-out controller connected to said memory and configured to cause said memory to output said digital code, an analog parameter signal generator connected to said memory and configured to convert said digital code to a first analog signal, and an acoustic signal generator connected to said analog-parameter signal generator and responsive to said first analog signal to generate said acoustic signal, in which said electric signal-to-acoustic signal converting means further includes a pilot signal generator connected between said memory and said analog parameter signal generator and generating a pilot sub-code representing that said digital code contains said parameters for adding said pilot sub-code to said digital code, in which said electric signal-to-acoustic signal converting means further includes an identity code generator configured to store an identity code assigned to said hearing aid for adding said identity code to said digital code, in which said electric signal-to-acoustic signal converting means further includes an error detecting code generator configured to generate an error detecting code used to determine whether or not an error bit is introduced into said digital code and adding said error detecting code to said digital code.

6. The hearing aid as set forth in claim 1, wherein said read-out controller is responsive to said externally-received signal provided directly to said read-out controller by an input port connected directly to said read-out controller.

7. A hearing aid connectable to a fitting apparatus for receiving parameters representative of hearing aid characteristics, comprising:

a sound-to-electric signal converter configured to generate a first electric signal representative of voice data information and a second electric signal representative of said parameters, said sound-to-electric converter configured to receive a voice representing said voice data information and an acoustic signal representative of said parameters to generate a first analog signal representing said voice data information and a second analog signal representing said parameters;

a voice reproducer responsive to a third electric signal representative of modified voice data information and configured to produce a voice;

a memory configured to store said parameters in a rewritable manner;

a signal processor connected between said sound-to-electric signal converter and said voice reproducer, and responsive to said parameters to generate said third electric signal through a signal processing on said first electric signal; and a parameter code generator connected to said sound-to-electric signal converter and configured to convert said first analog signal and said second analog signal to said first electric signal and said second electric signal both in the form of a digital code, in which said sound-to-electric signal converter further includes a switching element connected to said parameter code generator and providing an electric signal path therebetween before said acoustic signal is supplied to said sound-to-electric signal converter.

8. A hearing aid connectable to a fitting apparatus for receiving parameters representative of hearing aid characteristics, comprising:

a sound-to-electric signal converter configured to generate a first electric signal representative of voice data information and a second electric signal representative of said parameters, said sound-to-electric converter configured to receive a voice representing said voice data information and an acoustic signal representative of said parameters to generate a first analog signal representing said voice data information and a second analog signal representing said parameters;

a voice reproducer responsive to a third electric signal representative of modified voice data information and configured to produce a voice;

a memory configured to store said parameters in a rewritable manner;

a signal processor connected between said sound-to-electric signal converter and said voice reproducer, and responsive to said parameters to generate said third electric signal through a signal processing on said first electric signal; and a parameter code generator connected to said sound-to-electric signal converter and configured to convert said first analog signal and said second analog signal to said first electric signal and said second electric signal both in the form of a digital code, in which said acoustic signal further contains a piece of pilot information representing that said acoustic signal contains said parameters, and wherein said hearing aid further includes a pilot signal discriminator connected between said sound-to-electric signal converter and said parameter code generator and configured to discriminate said piece of pilot information to transfer said first analog signal and said second analog signal to said parameter code generator.

9. The hearing aid as set forth in claim 7, in which said acoustic signal further contains a piece of identity information representing that said parameters are supplied to said hearing aid, and said piece of identity information is transferred through said second analog signal to said second electric signal, wherein said hearing aid further includes an identity code discriminator configured to discriminate said piece of identity information to transfer said parameters to said memory.

10. The hearing aid as set forth in claim 9, in which said acoustic signal further contains a piece of error detecting information, and said piece of error detecting information is transferred through said second analog signal to said second electric signal, wherein said hearing aid further includes an error detector configured to check said second electric signal to determine whether or not at least one bit is contained therein for informing a user of said at least one error bit.

11. The hearing aid as set forth in claim 8, in which said acoustic signal further contains a piece of identity information representing that said parameters are supplied to said hearing aid, and said piece of identity information is transferred through said second analog signal to said second electric signal, wherein said hearing aid further includes an identity code discriminator configured to discriminate said piece of identity information to transfer said parameters to said memory.

12. The hearing aid as set forth in claim 11, in which said acoustic signal further contains a piece of error detecting information, and said piece of error detecting information is transferred through said second analog signal to said second electric signal, wherein said hearing aid further includes an error detector configured to check said second electric signal to determine whether or not at least one bit is contained therein for informing a user of said at least one error bit.

* * * * *